US011118332B2

(12) United States Patent
Manga et al.

(10) Patent No.: US 11,118,332 B2
(45) Date of Patent: Sep. 14, 2021

(54) HANDSHOWER HOLDER

(71) Applicant: Brasstech, Inc., Santa Ana, CA (US)

(72) Inventors: Joseph Manga, Irvine, CA (US); Thomas P. Beh, Corona Del Mar, CA (US)

(73) Assignee: Brasstech, Inc., Santa Ana, CA (US)

( * ) Notice: Subject to any disclaimer, the term of this patent is extended or adjusted under 35 U.S.C. 154(b) by 54 days.

(21) Appl. No.: 16/557,638

(22) Filed: Aug. 30, 2019

(65) Prior Publication Data

US 2021/0062485 A1 Mar. 4, 2021

(51) Int. Cl.
*E03C 1/06* (2006.01)
*E03C 1/04* (2006.01)

(52) U.S. Cl.
CPC ..... *E03C 1/066* (2013.01); *E03C 1/0409* (2013.01)

(58) Field of Classification Search
CPC ..... E03C 1/06; E03C 1/066; E03C 1/0409
USPC ..... 4/605
See application file for complete search history.

(56) References Cited

U.S. PATENT DOCUMENTS 2,621,968 A * 12/1952 Vickroy ..... E03C 1/066 239/283
4,174,822 A * 11/1979 Larsson ..... E03C 1/06 248/75
4,211,380 A 7/1980 Lillegard et al.
5,277,391 A 1/1994 Haug et al.
5,632,049 A * 5/1997 Chen ..... E03C 1/06 248/124.2
6,024,331 A 2/2000 Bischoff et al.
D425,608 S 5/2000 Haug et al.
6,123,308 A 9/2000 Faisst
6,473,916 B2 11/2002 Schiødt
6,802,089 B2 10/2004 Cropelli
7,000,265 B2 2/2006 Faisst
7,197,776 B2 4/2007 Tsai
7,407,140 B2 8/2008 Sen
7,721,363 B2 5/2010 Huang
7,766,291 B2 8/2010 Eilmus et al.
8,448,270 B2 5/2013 Yang
9,149,826 B2 10/2015 Vartanian et al.
9,200,651 B2 12/2015 Lin
D754,288 S 4/2016 Bahler
9,382,699 B2 7/2016 Andersen et al.
9,677,257 B2 6/2017 Andersen et al.
(Continued)

FOREIGN PATENT DOCUMENTS

EP 2642033 9/2013
GB 2202131 9/1988
WO WO2018078322 5/2018

OTHER PUBLICATIONS

Delta, Premium 3-Setting Slide Bar Hand Shower, retrieved Feb. 1, 2019 from https://www.deltafaucet.com/bathroom/product/57021, 2 pages.

(Continued)

*Primary Examiner* — Huyen D Le
(74) *Attorney, Agent, or Firm* — Bose McKinney & Evans LLP

(57) ABSTRACT

A handshower assembly includes a docking station with a first portion and a removable second portion. The docking station is configured to mount to a grab bar of a tub or shower and move relative to the grab bar for a user to position a handshower as desired.

19 Claims, 7 Drawing Sheets

(56) References Cited

U.S. PATENT DOCUMENTS

| | | | | |
|---|---|---|---|---|
| 2005/0028266 | A1 | 2/2005 | Cropelli | |
| 2009/0265848 | A1* | 10/2009 | Tsai | E03C 1/0408 4/615 |
| 2019/0390447 | A1 | 12/2019 | Herzog | |

OTHER PUBLICATIONS

Ciencia, Shower Sliding Bar Stainless Adjustable Hand Shower Wall Mount, retrieved Feb. 1, 2019 from https://www.amazon.com/CIENCIA-Shower-siding-Stainless-Adjustable/dp/B072Q9G3Z2, 4 pages.

Brasstech Inc., Drawing of Side Bar Holder ASM—TRAD, on sale prior to Aug. 30, 2018, 1 pg.

Newport Brass, Installation Instructions, Slide Bar Assembly, Model No. 294,295, NWP-294, dated Oct. 10, 2011, 1 pg.

* cited by examiner

HANDSHOWER HOLDER

BACKGROUND AND SUMMARY OF THE DISCLOSURE

The present disclosure relates to shower and tub accessories. More specifically, the present disclosure relates to a handshower docking station or holder that can be mounted to a grab bar installed on a shower or tub wall.

Conventional showerheads are typically fixed on a shower wall at a certain height and have a limited number of angles at which they can spray water. This can be inconvenient for a user who may desire to have more control over the angle and direction of water spray. Additionally, conventional baths and showerheads may be inconvenient for users who are attempting to bath children or pets in a conventional bathtub for these same reasons. As such, handshowers are often utilized to relieve such inconveniences.

A conventional handshower may be in fluid communication with a flexible hose which, in turn, is fluidly coupled with a water source spaced apart from the sprayhead of the handshower. Such a handshower may be docked at a fixed location within the shower or tub, and may be undocked for use when greater flexibility of use is desired. The handshower may be docked at the same position as a conventional fixed showerhead when not in use. Such a docking position may present problems to users who are not be able to reach such a docking position, for example, disabled or elderly users. Furthermore, such docking stations are typically semi-permanent and are not easily movable should the user want to change the position of the docking station. As such, it is often desired to provide a moveable holder for a handshower that may be easily installed on a conventional shower wall.

A handshower assembly is disclosed herein as including a docking station or holder with a first portion and a removable second portion. The docking station is configured to removably support a handshower, and to mount to a grab bar of a tub or shower and move relative to the grab bar for a user to position the handshower as desired.

According to an illustrative embodiment of the present disclosure, a handshower assembly includes a docking station having a body with a first portion and a second removable portion, the first portion having a first sleeve and the second removable portion having a second sleeve. A handshower holder is coupled to the docking station, and a stem adapter is coupled to the docking station, wherein movement of the stem adapter results in movement of the first sleeve.

According to another illustrative embodiment of the present disclosure, a handshower assembly includes a docking station having a body with a first portion and a second removable portion, the first portion having a first sleeve and the second removable portion having a second sleeve. A handshower holder is coupled to the docking station, and a handshower is removably supported by the handshower holder. A grab bar includes opposing curved ends and a linear center portion, wherein the docking station is mounted on the center portion of the grab bar.

According to a further illustrative embodiment of the present disclosure, a method of positioning a handshower includes the steps of providing a handshower assembly including a docking station having a body with a first portion and a second removable portion, the first portion having a first sleeve and the second portion having a second sleeve, a handshower holder coupled to the docking station and supporting a handshower, and a stem adapter coupled to the docking station, wherein the first sleeve is configured to move in response to movement of the stem adapter. The method further includes the steps of positioning a grab bar within the first portion of the body of the docking station, coupling the second removable portion of the body of the docking station to the first portion so that the grab bar extends within the body of the docking station, and moving the stem adapter so that the first sleeve moves to secure the position of the docking station relative to the grab bar.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

A detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention.

Figure 1:
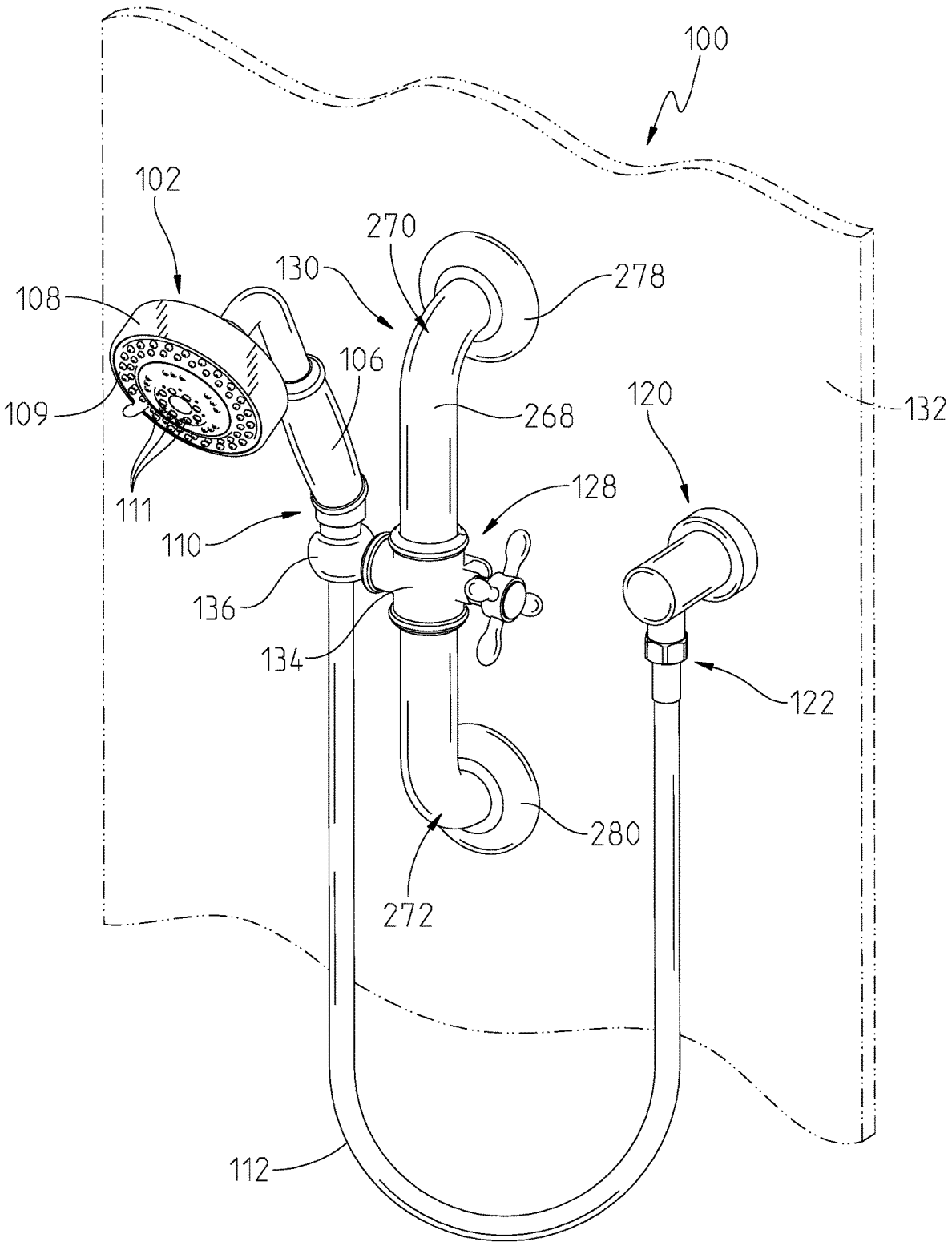
FIG. 1 is a perspective view of an illustrative handshower assembly including a handshower removably coupled to a docking station supported for movement along a grab bar.
Figure 2:
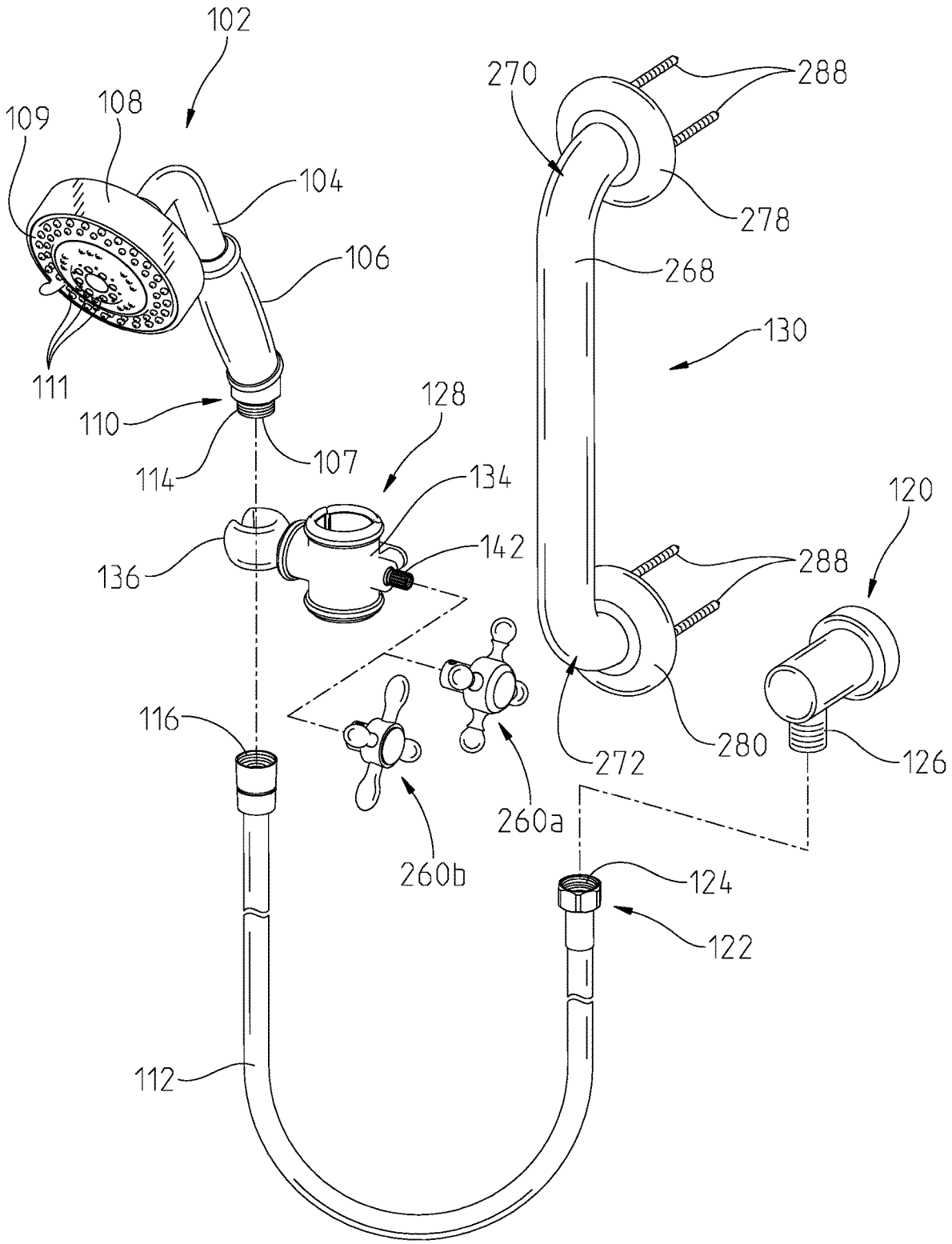
FIG. 2 is an exploded view of the handshower assembly of FIG. 1.

Referring initially to FIGS. 1 and 2, an illustrative handshower assembly 100 is shown as including a flexible hose 112 coupled to a handshower 102 at a first end and to a supply elbow 120 at a second end opposite the first end. A docking station or holder 128 is removably coupled to a grab bar 130 attached to a shower or tub wall 132. The handshower 102 removably couples to the docking station 128 to facilitate the retention of the handshower 102 in a desired position either while in use or between uses.

With further reference to FIG. 2, the handshower 102 illustratively includes a handshower body 104 having a handle 106 and a sprayhead 108. The handle 106 illustratively includes a fluid inlet 107, while the sprayhead 108 illustratively includes a faceplate 109 having a plurality of fluid outlets 111. In an illustrative embodiment, the handshower 102 additionally has a fluid coupler 110 at the opposite end of the handshower body 104 from the sprayhead 108 (i.e., at the fluid inlet 107). The fluid coupler 110 is configured to couple the handshower 102 with the hose 112. For example, the fluid coupler 110 may include external threads 114 configured to mate with internal threads 116 of the hose 112. In other illustrative embodiments, the handshower 102 may be coupled to the hose 112 via other fluid couplers 110, such as, but not limited to, adhesive, welding, mechanical fasteners, unitary manufacturing, etc. Additionally, other illustrative embodiments of the handshower 102 may not include a handle 106 distinct from the handshower body 104.

In an illustrative embodiment, the hose 112 may be coupled to the supply elbow 120 at the opposite end of the hose 112 from the handshower 102 via a fluid coupler 122. In the illustrative embodiment shown in FIG. 2, the fluid coupler 122 may include internal threads 124 configured to mate with external threads 126 on the supply elbow 120. In other illustrative embodiments, the hose 112 may be coupled to the supply elbow 120 via other fluid couplers 122, such as, but not limited to, adhesive, welding, mechanical fasteners, unitary manufacturing, etc. The supply elbow 120 is illustratively in fluid communication with a water source (not shown) and is located on the wall 132 of the shower and/or tub (FIG. 1). When assembled, the sprayhead 108 may be in fluid communication with the water source (not shown) via the hose 112 and the supply elbow 120 via a user operated control valve (e.g., a mixing valve).

Referring now to FIGS. 1-4, the illustrative docking station 128 includes a holder or docking station body 134 configured to receive the grab bar 130, and a handshower holder or cradle 136 configured to receive the handshower 102. The docking station 128 facilitates the retention of the handshower 102 in a desired position relative to the docking station 128 either while the handshower 102 is in use or between uses. For example, in an illustrative embodiment, the handshower cradle 136 may form a "C" shaped body defined by opposing arms 137. Illustratively, a gap 139 between the arms 137 (i.e., within the perimeter of the "C" shape) is at least sized to receive the diameter of the hose 112, while the perimeter of the "C" shaped body is less than the perimeter of at least a portion of the handshower body 104 so that the handshower 102 is removably supported by the "C" shaped body while the hose 112 is free to pass through the handshower cradle 136. In other illustrative embodiments, the handshower cradle 136 may encompass a variety of shapes and sizes, such as a full circle, a semi-circle, or a variety of polygons, and may further include either closed or unclosed perimeters. The handshower cradle 136 may also be sized to allow a substantial portion, including a majority, of the handshower 102 to pass through an opening of the handshower cradle 136 (e.g., the handle 106), or may otherwise be sized to only allow the hose 112 to pass through the opening of the handshower cradle 136.

Figure 3:
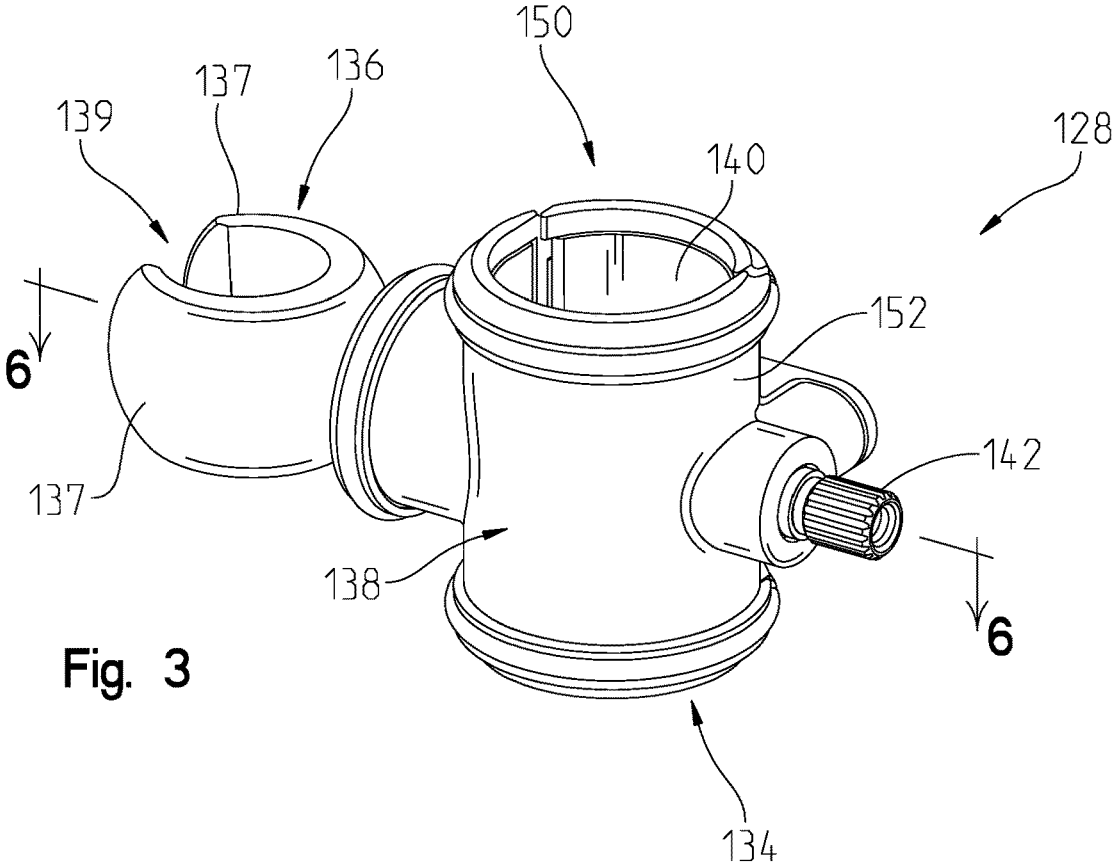
FIG. 3 is a front perspective view of an illustrative docking station of the handshower assembly of FIG. 1.
Figure 4:
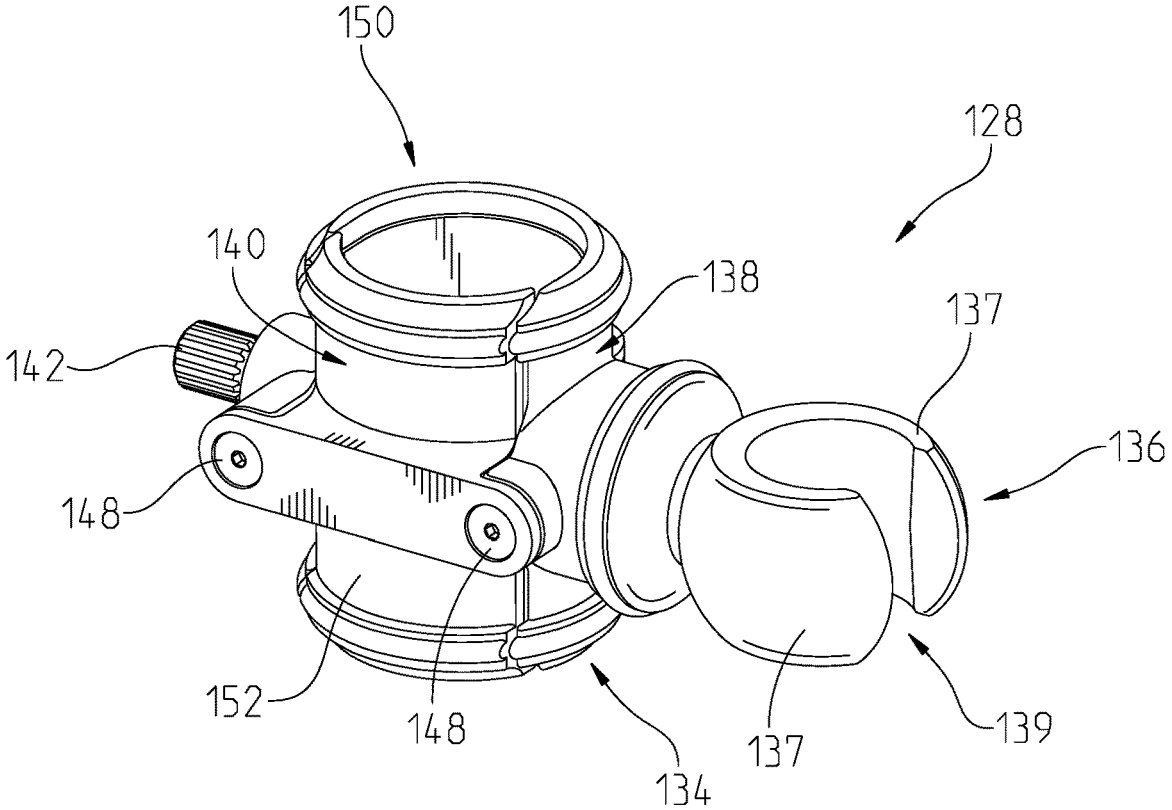
FIG. 4 is a rear perspective view of the docking station of FIG. 3.

Referring now to FIGS. 3 and 4, the illustrative docking station 128 includes the docking station body 134 having a first, main portion or member 138 and a second, removable portion or member 140. In the illustrative embodiment, the main portion 138 comprises a majority of the docking station body 134 and has an arcuate body extending circumferentially more than 180 degrees (e.g., approximately 260 degrees). The body 134 illustratively serves as the base for the handshower cradle 136 and a stem adapter 142 configured to support a handle 260 (FIG. 2). The removable portion 140 therefore illustratively comprises a smaller portion of the docking station body 134 than the main portion 138. More particularly, the removable portion 140 has an arcuate body extending circumferentially less than 180 degrees (e.g., approximately 100 degrees).

In an illustrative embodiment as depicted, the removable portion 140 may be coupled to the main portion 138 using mechanical fasteners, such as hex screws 148 (FIG. 4). In other illustrative embodiments, other methods of removably coupling the removable portion 140 to the main portion 138 may be used. For example, hooks, clasps, clamps, adhesives, magnets, buttons, latches, grooves, clips, buckles, and/or hook-and-loop fasteners may be utilized. Additionally, in other embodiments, the removable portion 140 may serve as the base for the handshower cradle 136, the stem adapter 142, or both.

Still referring to FIGS. 3-4, and as discussed above, when assembled, the docking station body 134 illustratively forms a cylindrical opening 150 defined by a sidewall 152 and sized to receive the grab bar 130 (FIGS. 1-2). In other embodiments, the docking station body 134 may form openings in alternate sizes or shapes to receive any variety of grab bars. For example, the docking station body 134 may form an opening 150 shaped as a semi-circle or any kind of polygon to receive a grab bar 130 with a corresponding shape and size. When unassembled, the gap left in sidewall 152 of the docking station body 134 after removal of the removable portion 140 is sized to receive the diameter of the grab bar 130 (FIGS. 1-2) so that the main portion 138 can at least partially encircle the grab bar 130 (FIGS. 1-2). The removable portion 140 may then be replaced in the gap left in the sidewall 152 and secured to the main portion 138 so that the grab bar 130 is fully encircled by the docking station 128. In other illustrative embodiments, the docking station 128 may not fully encircle the grab bar 130 but may substantially surround the grab bar 130 in a manner that the docking station 128 may remain in place on grab bar 130.

Figure 5:
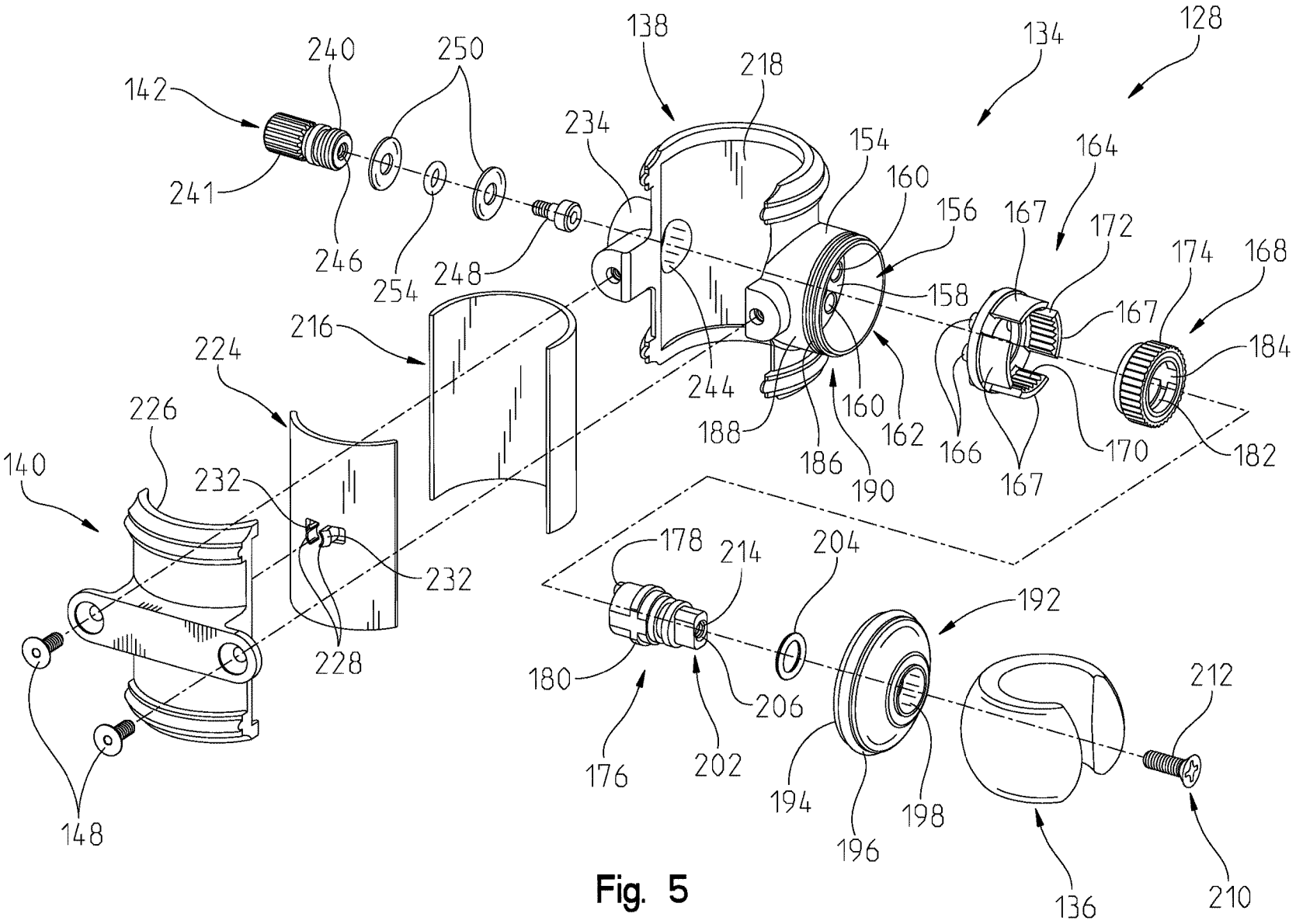
FIG. 5 is an exploded perspective view of the docking station of FIG. 3.
Figure 6:
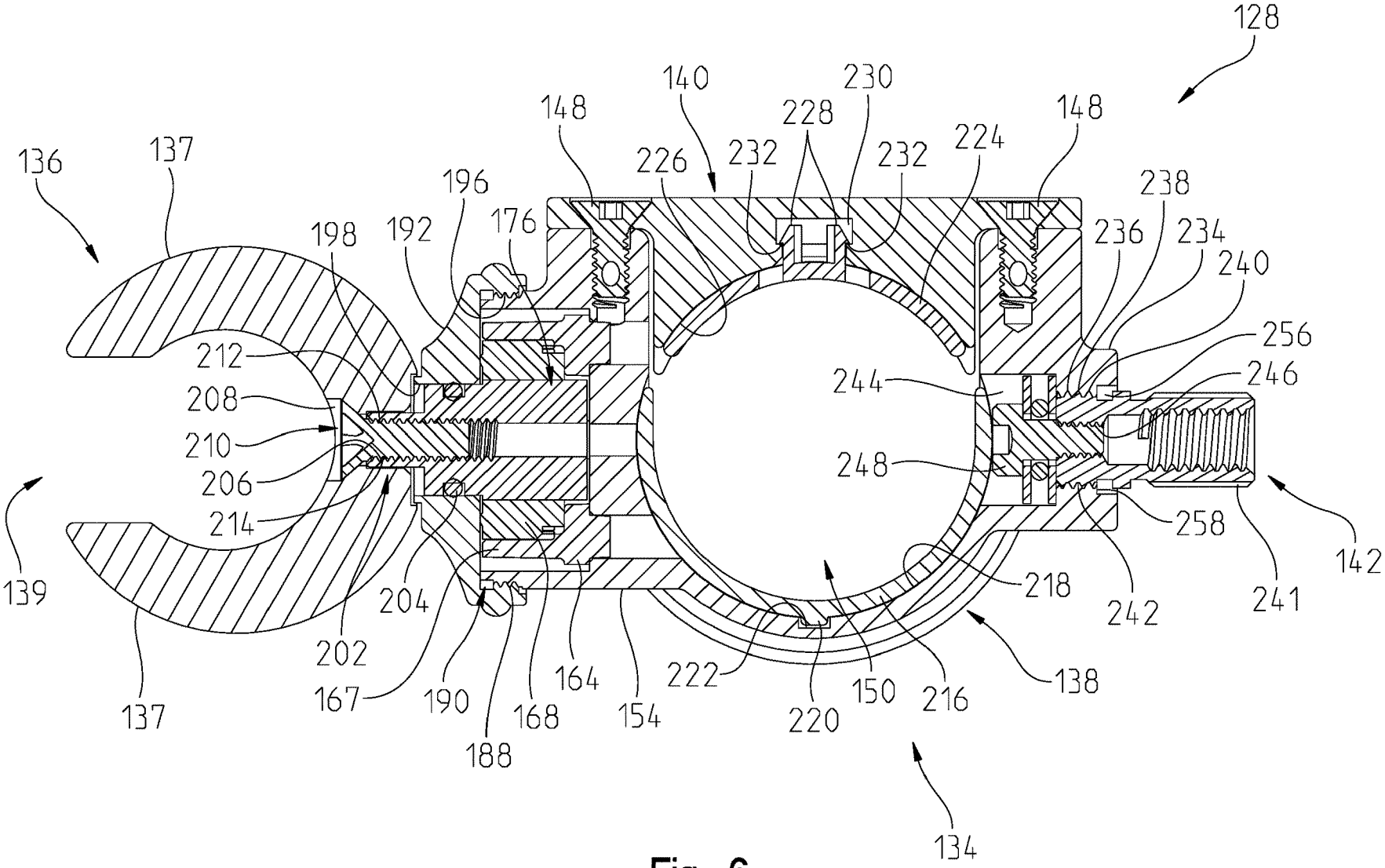
FIG. 6 is a cross-sectional view of the docking station of FIG. 3, taken along line 6-6.

Referring to FIGS. 5-6, assembly of the docking station 128 is disclosed. As discussed above, the main portion 138 of the docking station body 134 serves as the base for the handshower cradle 136. Specifically, the docking station body 134 has a first branch 154 forming a cavity 156 with a bottom 158 having first locating members 160, and an opening 162 opposite the bottom 158 sized to receive an outer spline 164. The outer spline 164 includes second locating members 166 configured to mate with the first locating members 160 on the bottom 158 of the cavity 156. In an illustrative embodiment, the second locating members 166 comprise pegs or tabs, and the first locating members 160 comprise recesses or pockets, wherein the pegs 166 are configured to be received by the pockets 160. In other illustrative embodiments, alternate examples of locating members may be used. The outer spline 164 may also include tabs 167, the tabs 167 spaced apart in a manner facilitating the outer spline 164 to receive an inner spline 168. In an illustrative embodiment, the tabs 166 may include teeth or splines 170 on an inner face 172 of the tabs 167 that are capable of mating with threads or splines 174 located on the outer perimeter of the inner spline 168.

A rotating member or stem 176 may be disposed through the inner spline 168 and communicate with the bottom 158 of the cavity 156 via first locating members 160 and third locating members 178 disposed on the bottom of the rotating member 176. Rotation of the rotating member 176 may be communicated to the inner spline 168 via a flange-and-groove connection between the rotating member 176 and inner spline 168. For example, in an illustrative embodiment, the rotating member 176 includes flange 180 configured to mate with a groove 182 located on an inner surface 184 of the inner spline 168. Other embodiments may utilize a latch system, a tab system, or threading to facilitate communication between the rotating member 176 and the inner spline 168.

A cover flange 192 may cover the cavity 156 of the first branch 154 and its contents, including the outer spline 164, the inner spline 168, and the rotating member 176, to give the docking station 128 an aesthetically pleasing look while providing a transition from the docking station 128 to the handshower cradle 136. The handshower holder first branch 154 may comprise threading 186 on an outer perimeter 188 of a distal portion 190 of the first branch 154 configured to mate with threading 194 located on an inner perimeter 196 of the cover flange 192 so that the cover flange 192 may be coupled with the first branch 154. In other embodiments, other coupling means may be utilized, including hooks, clasps, clamps, adhesives, magnets, buttons, latches, grooves, clips, buckles, and/or hook-and-loop fasteners. In yet other embodiments, the cover flange 192 may be fixedly attached to the first branch 154 using a variety of manufacturing methods, including welding, after the interior components of the first branch 154 have been assembled.

Still referring to FIGS. 5-6, in the illustrative embodiment, the cover flange 192 forms an aperture 198 that gives access to an upper portion 202 of the rotating member 176. A seal 204 may be positioned between the cover flange 192 and the rotating member 176 about the aperture 198 to facilitate a connection between the cover flange 192 and the rotating member 176 that allows for rotation of the rotating member 176 independent of the cover flange 192, so that the rotating member 176 may rotate while the cover flange 192 remains stationary. The upper portion 202 of the rotating member 176 accessible through the aperture 198 of the cover flange 192 may include a fastener opening 206.

The handshower cradle 136 is illustratively disposed on the cover flange 192 and includes an aperture 208 for receiving a mechanical fastener, such as a screw 210. The screw 210 may pass through an aperture 208 of the handshower cradle 136 and the aperture 198 of the cover flange 192 to engage with the fastener opening 206. Illustratively the screw 210 engages with the fastener opening 206 via threading 212 disposed on the screw 210 and threading 214 disposed within the fastener opening 206. As illustratively manufactured, the handshower cradle 136 maintains the ability to rotate about an axis substantially orthogonal to the cylindrical opening 150 of the docking station 128 or rotate about another axis that does not interfere with the function of the docking station 128, allowing a user to place the handshower 102 in a variety of desired positions when the handshower 102 is docked within the handshower cradle 136. The relative rotational position of the cradle 136 is fixed via interaction of the outer spline 164 and the inner spline 168. In other embodiments, other fasteners may be used. In yet other embodiments, the handshower cradle 136 may be fixedly attached to the cover flange 192 through a variety of manufacturing means, including, but not limited to, welding or unitary construction. Such a construction may not allow the handshower cradle 136 to rotate.

The main portion 138 receives a main sleeve 216 that is shaped and sized to correspond with the inner sidewall 218 of the main portion 138. The main sleeve 216 may be formed of a friction enhancing material, such as a polymer, an elastomer or mixture thereof. Proper placement of the main sleeve 216 along the inner sidewall 218 may be ensured using a tab 220 located on the main sleeve 216 corresponding with a recess or divet 222 located on the inner sidewall 218. In other embodiments, such locating elements may be absent. The cooperating shapes of the sleeve 216 and the inner sidewall 218 facilitate frictional engagement and coupling between the sleeve 216 and the main portion 138 of the docking station body 134.

Similarly, the removable portion 140 receives a removable sleeve 224 that is shaped and sized to correspond with the inner sidewall 226 of the removable portion 140. The removable sleeve 224 may be formed of a friction enhancing material, such as a polymer, an elastomer or mixture thereof. Proper placement and retention of the removable sleeve 224 along the inner sidewall 226 may be ensured using tabs 228, which correspond to an opening 230 formed in the inner sidewall 226. When the tabs 228 are pushed into the opening 230, they must bend toward each other to conform to a size that corresponds with the opening 230. Once inside the opening 230, the tabs may spring back to their default position, and ridges 232 lock the tabs within the opening 230. As discussed above, the removable portion 140 may be coupled to the main portion 138 using mechanical fasteners, such as hex screws 148. As discussed above, in other embodiments, other methods of removably coupling the removable portion 140 to the main portion 138 may be used. For example, hooks, clasps, clamps, adhesives, magnets, buttons, latches, grooves, clips, buckles, and/or hook-and-loop fasteners may be utilized.

Still referring to FIGS. 5-6, the main portion 138 may also serve as the base for the stem adapter 142. Specifically, a second branch 234 is disposed on the docking station body 134 to facilitate the coupling of the stem adapter 142 to the holder body 134. In an illustrative embodiment, the stem adapter 142 and the handshower cradle 136 are arranged coaxially on the holder body 134. In other embodiments, the stem adapter 142 and the handshower cradle 136 may be arranged upon the holder body 134 in a variety of ways that does not interfere with the function of the docking station 128. The stem adapter 142 is comprised of a branch portion 240 and a handle portion 241. The second branch 234 defines an aperture 236 with internal threads 238 and sized to receive the branch portion 240 of the stem adapter 142, the branch portion 240 having external threads 242 configured to mate with the threads 238 of the aperture 236. A cavity 244 is formed in the inner sidewall 218 of the docking station body 134 in communication with the aperture 236. When assembled, the stem adapter 142 is coupled with the second branch 234 so that the branch portion 240 of the stem adapter 142 is mated with the second branch 234 and the handle portion 241 extends from the docking station body 134.

The branch portion 240 of the stem adapter 142 forms a fastener opening 246 capable of receiving a fastener, such as a screw 248. The screw 248 may be inserted into the cavity 244 and mated with the fastener opening 246 of the stem adapter 142. In other embodiments, a number of alternate fasteners may be utilized as described through the present description. In an illustrative embodiment, washers 250 and an elastomeric o-ring 252 are disposed between the screw 248 and the stem adapter 142.

Referring specifically to FIG. 6, when the docking station 128 is assembled, the main sleeve 216 illustratively covers the cavity 244 located within the inner sidewall 218 of the docking station body 134 and contacts a head 254 of the screw 248. Additionally, a gap 256 is left between the handle portion 241 of the stem adapter 142 and a ledge 258 of the aperture 236, which allows limited movement of the stem adapter 142 within the aperture 236. For example, when the stem adapter 142 is rotated in a first direction, the coupled connection between the stem adapter 142 and the second branch 234 allows axial movement of the stem adapter 142 toward the interior of the docking station 128. The stem adapter 142 places pressure on the washers 250 and the seal 252, which places pressure on the screw 248. The screw 248 transfers the pressure to the main sleeve 216 through the contact with the main sleeve 216 via the head 254 of the screw 248, which causes the main sleeve 216 together with the removable sleeve 224 to form a smaller diameter. When the docking station 128 is positioned on a grab bar 130, this tightening of the sleeves 216, 224 facilitates a friction hold (or clamping) on the grab bar 130 and holds the docking station 128 in place on the grab bar 130.

When the stem adapter is rotated in a second direction opposite from the first direction, the coupled connection between the stem adapter 142 and the second branch 234 allows axial movement of the stem adapter 142 away from the docking station 128. This movement pulls the screw 248 away from the main sleeve 216, allowing the main sleeve 216 together with the removable sleeve 224 to return to a larger, default diameter. When the docking station 128 is positioned on a grab bar 130, this loosening of the sleeves 216, 224 releases the friction hold on the grab bar 130 and allows movement of the docking station 128 along the grab bar 130.

Figure 7:
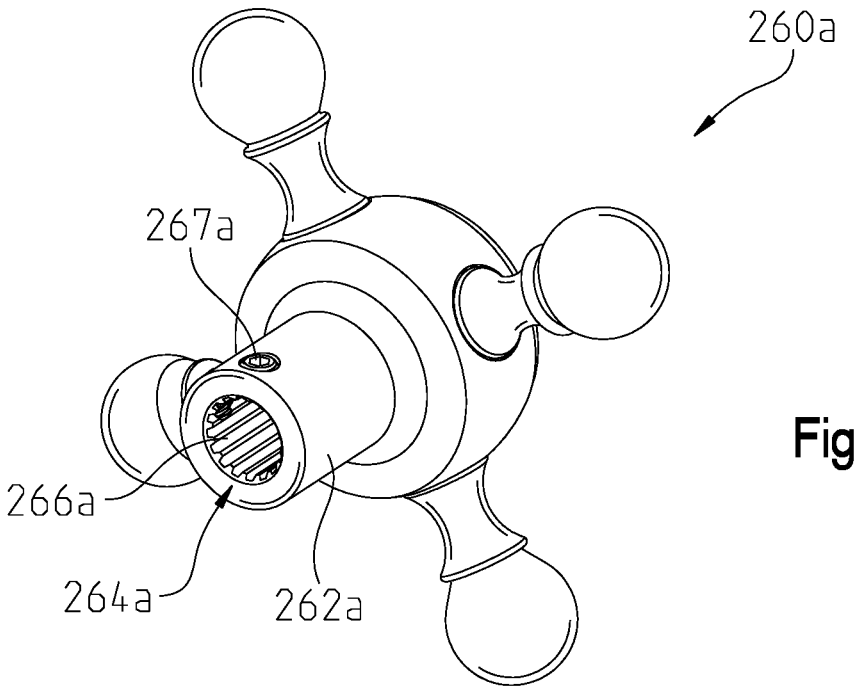
FIG. 7 is a perspective view of an illustrative handle for use with the handshower assembly of FIG. 1.
Figure 8:
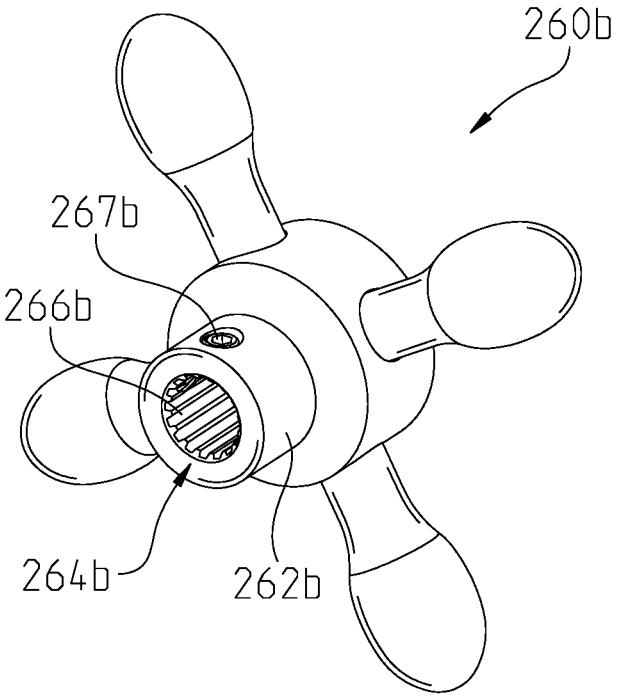
FIG. 8 is a perspective view of another illustrative handle for use with the handshower assembly of FIG. 1.

Now referring to FIGS. 7-8, illustrative examples of handles are disclosed. For example, either the handle 260*a* or 260*b* may be utilized with the docking station 128 (FIGS. 1-6) of the present disclosure. Other handle designs may be imagined by one skilled in the art. Both handles 260*a* and 260*b* include a coupling arm 262*a*, 262*b* forming a receiving channel 264*a*, 264*b*. The receiving channels 264*a* and 264*b* are lined with ridges or splines 266*a*, 266*b* corresponding with the ridges or splines arranged around the handle portion 241 of the stem adapter 142 (FIGS. 5-6) so that the receiving channel 264*a*, 264*b* of the respective handle 260*a*, 260*b* can receive the handle portion 241 of the stem adapter 142 (FIGS. 5-6). Each handle 260*a*, 260*b* further has a tightening or set screw 267*a*, 267*b* to secure the handle 260*a*, 260*b* to the stem adapter 142 (FIGS. 1-6) when coupled. This arrangement allows for the user to change handles on the docking station 128 (FIGS. 1-6) depending on the user's aesthetic preferences. Other arrangements are possible, including either removable or permanent couplings otherwise described herein. The handle 260*a*, 260*b* further facilitates movement of the stem adapter 142 to accomplish the tightening or loosening of the main sleeve 216 as described above (FIGS. 5-6).

Figure 9:
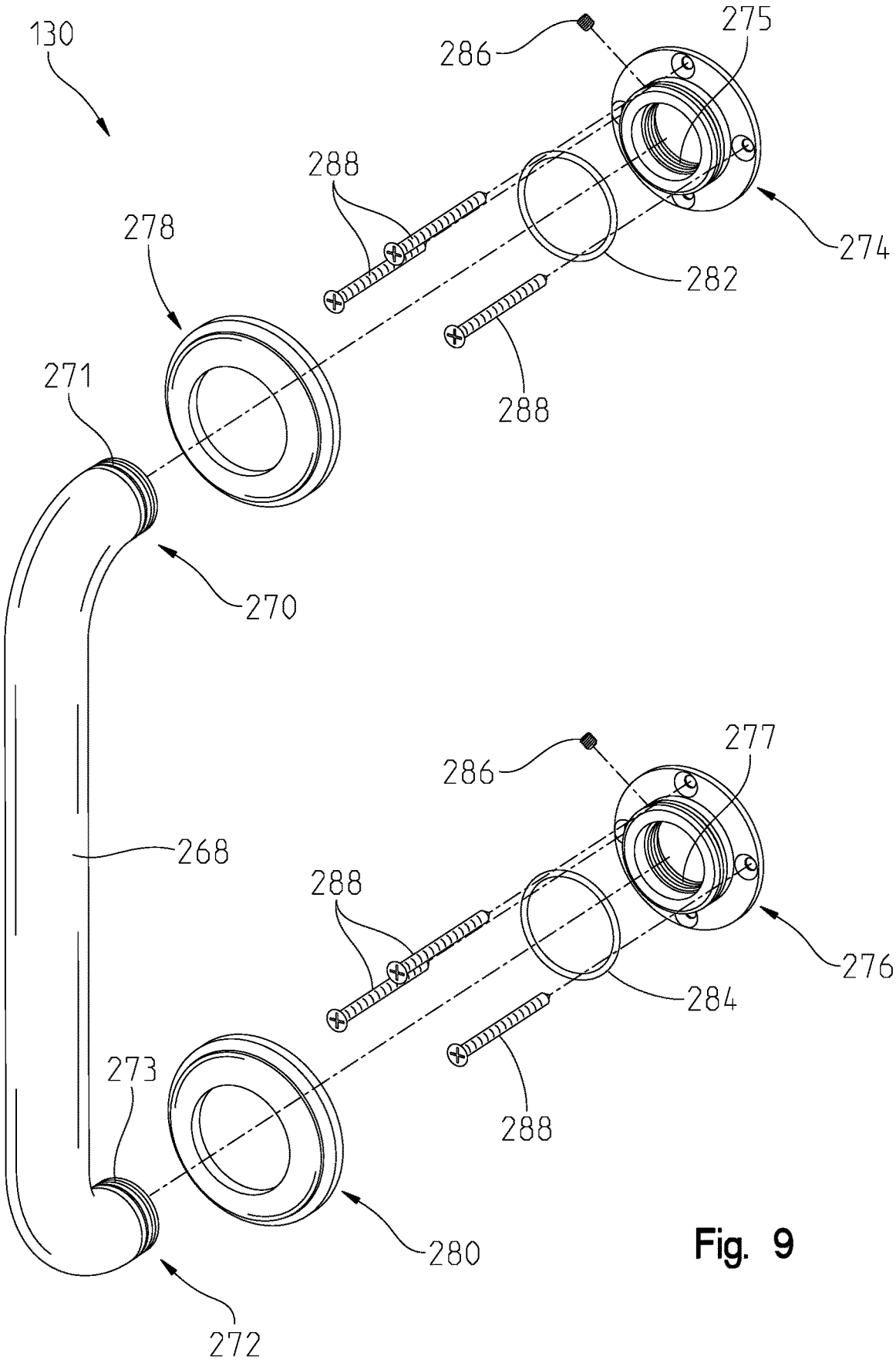
FIG. 9 is an exploded view of an illustrative grab bar for use with the handshower assembly of FIG. 1.

FIG. 9 discloses an illustrative grab bar 130 for use with the handshower assembly 100. The grab bar 130 illustratively includes a cylindrical body or tube that, when assembled, may be grabbed by a user for assistance getting in and out of a tub and/or shower. The grab bar 130 may also be utilized to support the docking station 128 (FIGS. 5-6).

With reference to FIGS. 1 and 2, the illustrative grab bar 130 may include a linear or straight center portion 268 positioned intermediate opposing curved first and second ends 270 and 272. The two-piece structure of the docking station body 134 (i.e., the removable portion 140 releasably coupled to the main portion 138) facilitates coupling of the docking station 128 to the grab bar 130 without requiring that the docking station body 134 slide over one of the curved ends 270, 272.

A first mounting ring 274 and a second mounting ring 276 are configured to mate with the first end 270 and the second end 272 of the grab bar 130 to facilitate the mounting of the grab bar 130 to the tub and/or shower wall 132. In the illustrative embodiment, the first end 270 of the grab bar 130 includes external threads 271 configured to mate with internal threads 275 on the first mounting ring 274, and the second end 272 of the grab bar 130 includes external threads 273 configured to mate with internal threads 277 on the second mounting ring 276. In other illustrative embodiments, other methods of coupling the grab bar 130 to the mounting rings 274, 276 may be utilized as otherwise described herein. A set screw 286 may be used to further secure the grab bar 130 to the mounting rings 274, 276. A first decorative cover 278 and a second decorative cover 280 may be disposed between the respective mounting rings 274, 276 and the grab bar 130 for aesthetic purposes. A first seal 282 and a second seal 284 may be disposed between the respective mounting rings 274, 276 and the respective decorative covers 278, 280 to facilitate a friction fit between the mounting rings 274, 276 and the decorative covers 278, 280. Illustratively, the mounting rings 274, 276 may be fastened to the tub and/or shower wall 132 using mounting screws 288.

Although the invention has been described in detail with reference to certain preferred embodiments, variations and modifications exit within the spirit and scope of the invention as described and defined in the following claims.

What is claimed is:

1. A handshower assembly comprising:

a docking station having a body with a first portion and a second removable portion, the first portion having a first sleeve and the second removable portion having a second sleeve;

wherein the first portion and the second removable portion of the body of the docking station form a first diameter;

a handshower holder coupled to the docking station;

a stem adapter coupled to the docking station;

wherein movement of the stem adapter results in movement of the first sleeve; and wherein movement of the stem adapter results in movement of the first sleeve so that the first sleeve and the second sleeve form a second diameter, wherein the second diameter is smaller than the first diameter.

2. The handshower assembly of claim 1, further comprising a grab bar including opposing curved ends and a linear center portion, wherein the docking station is mounted on the center portion of the grab bar.

3. The handshower assembly of claim 1, the handshower assembly further comprising a handshower supported by the handshower holder.

4. The handshower assembly of claim 3, the handshower assembly further comprising a hose having a first end and a second end, the first end coupled to the handshower and the second end coupled to a water source.

5. The handshower assembly of claim 1, the docking station further comprising a handle removably coupled to the stem adapter.

6. A handshower assembly comprising:

a docking station having a body with a first portion and a second removable portion, the first portion having a first sleeve and the second removable portion having a second sleeve;

a releasable fastener securing the first portion of the body with the second removable portion of the body;

a stem adapter coupled to the docking station, wherein movement of the stem adapter results in movement of the first sleeve;

a handshower holder coupled to the docking station; and a handshower is removably supported by the handshower holder;

a grab bar includes opposing curved ends and a linear center portion, wherein the docking station is mounted on the center portion of the grab bar;

wherein the first portion and the second removable portion of the body of the docking station form a first diameter sized to receive the center portion of the grab bar when assembled; and wherein movement of the stem adapter results in movement of the first sleeve so that the first sleeve and the second sleeve form a second diameter, wherein the second diameter is smaller than the first diameter.

7. The handshower assembly of claim 6, the handshower assembly further comprising a hose having a first end and a second end, the first end coupled to the handshower and the second end coupled to a water source.

8. The handshower assembly of claim 6, the docking station further comprising a handle removably coupled to the stem adapter.

9. A method of positioning a handshower, the method comprising:

providing a handshower assembly including:

a docking station having a body with a first portion and a second removable portion, the first portion having a first sleeve and the second removable portion having a second sleeve;

a handshower holder coupled to the docking station and supporting a handshower; and a stem adapter coupled to the docking station, wherein the first sleeve is configured to move in response to movement of the stem adapter;

positioning the grab bar within the first portion of the body of the docking station;

coupling the second removable portion of the body of the docking station to the first portion so that the grab bar is surrounded by the body of the docking station;

securing via a fastener the second removable portion of the body with the first portion of the body; and moving the stem adapter relative to the first portion of the body so that the first sleeve moves wherein a diameter defined by the first sleeve and the second sleeve is reduced to secure the position of the docking station relative to the grab bar.

10. The method of claim 9, the handshower assembly further including a handle coupled to the stem adapter, wherein movement of the handle facilitates movement of the stem adapter.

11. The method of claim 10, wherein the handle is removably coupled to the stem adapter.

12. The method of claim 9, wherein the handshower is in fluid communication with a water source.

13. The method of claim 12, wherein the water source is spaced apart from the docking station.

14. The method of claim 9, wherein the handshower holder is configured to move relative to docking station.

15. A handshower assembly comprising:

a docking station having a body with a first portion and a second removable portion, the first portion having an arcuate first inner sidewall, and the second removable portion having an arcuate second inner sidewall;

an arcuate first sleeve coupled to the first inner sidewall of the first portion of the body;

an arcuate second sleeve coupled to the second inner sidewall of the second removable portion of the body;

wherein the arcuate first sleeve together with the arcuate second sleeve define a first diameter;

a releaseable fastener coupling the first portion of the body with the second removable portion of the body;

a handshower holder coupled to the docking station;

a stem adapter coupled to the docking station; and wherein movement of the stem adapter results in movement of the first sleeve.

16. The handshower assembly of claim 15, wherein movement of the stem adapter results in movement of the first sleeve so that the first sleeve and the second sleeve form a second diameter, wherein the second diameter is smaller than the first diameter.

17. The handshower assembly of claim 15, further comprising a handshower supported by the handshower holder.

18. The handshower assembly of claim 15, wherein the docking station further includes a handle removably coupled to the stem adapter.

19. The handshower assembly of claim 15, wherein the first inner sidewall of the body includes a first opening, the second inner sidewall of the body includes a second opening, the first sleeve includes a first tab received within the first opening, and the second sleeve includes a second tab received within the second opening.

* * * * *